United States Patent [19]

Lentini

[11] 4,123,978

[45] Nov. 7, 1978

[54] SAFE

[76] Inventor: James J. Lentini, 2050 Mission Ridge Rd., Santa Barbara, Calif. 93103

[21] Appl. No.: 803,980

[22] Filed: Jun. 6, 1977

[51] Int. Cl.[2] ..... E05G 1/02

[52] U.S. Cl. ..... 109/51; 109/54; 109/68

[58] Field of Search ..... 109/50–57, 109/66, 68

[56] References Cited

U.S. PATENT DOCUMENTS

| | | | |
|---|---|---|---|
| Re. 9,305 | 7/1880 | Heineman | 109/54 X |
| 339,779 | 4/1886 | Huntley | 109/52 |
| 1,644,410 | 10/1927 | Belknap | 109/50 |
| 1,717,682 | 6/1929 | Hahn | 109/51 X |

*Primary Examiner*—Mervin Stein
*Assistant Examiner*—David H. Corbin
*Attorney, Agent, or Firm*—Harness, Dickey & Pierce

[57] ABSTRACT

The present invention pertains to a wall safe designed such that it may be conveniently built into and secured to any new or existing structure such as a building, vehicle, or the like. The wall safe comprises a top, bottom, and four side walls, one of which has a door providing access to the interior. The door is movably secured to the side wall near the top of the opening by means of concealed hinges at opposite sides thereof. Additionally, the safe is provided with a removable shelf which appears to be the bottom of the safe but conceals a secret compartment therebelow. In one embodiment, the wall safe is sized to fit between existing or new studs or joints of a conventional wood frame building. In another embodiment, the invention is provided with a flanged bottom portion to aid in embedding the safe in a concrete floor or the like.

In yet another embodiment, several of the wall safes may be assembled or stacked together to form a table like structure suitable for hotel lobbies or the like.

In another embodiment of the invention, a slot or space is provided at the top of the door thus allowing deposits to be made without opening or unlocking of the safe. Any suitable locking arrangement may be fitted to the door to provide the desired security.

1 Claim, 5 Drawing Figures

FIG. 1.
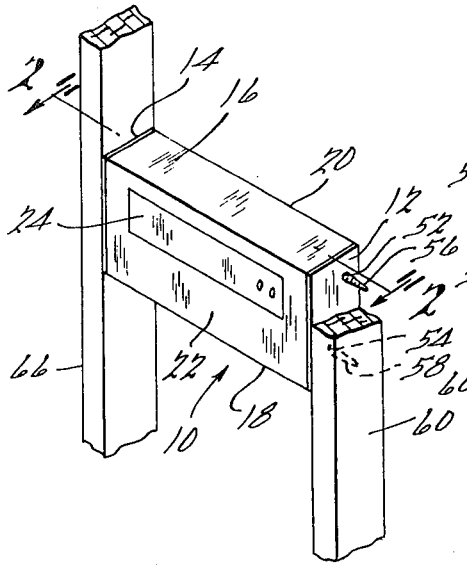
FIG. 2.
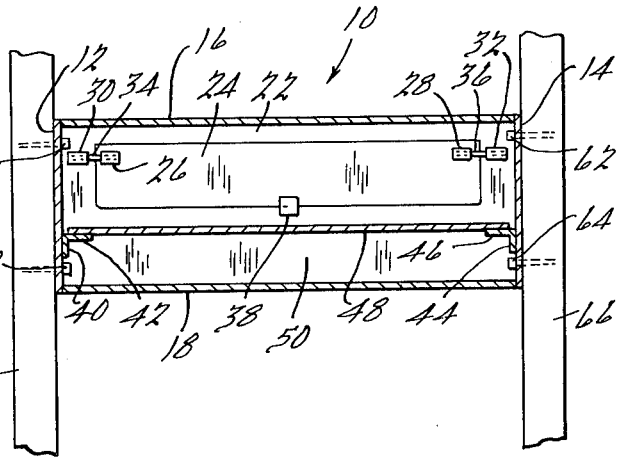
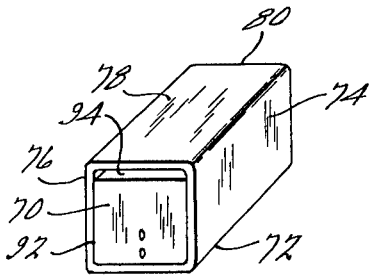
FIG. 4.
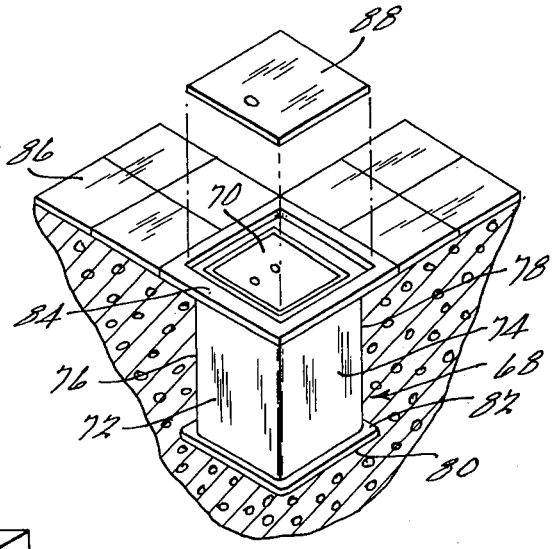
FIG. 3.
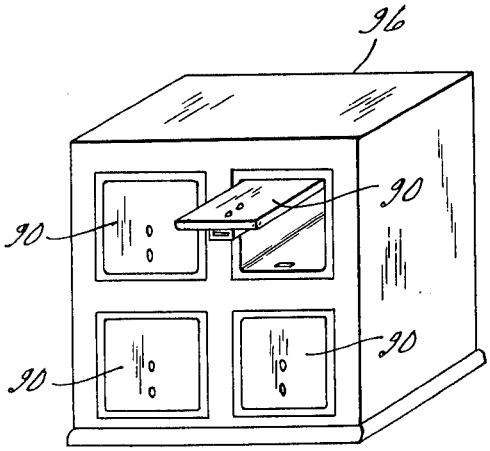
FIG. 5.

SAFE

BACKGROUND AND SUMMARY OF THE INVENTION

Wall safes are well known devices commonly being used in residential or other buildings to provide a secure storage place for money, jewelry and other assorted valuables. Such structures are often large in size thus requiring substantially thicker room wall construction in order to fully conceal them. Further, special framing may be required as the size prohibits insertion between existing studs or additional framing is required to secure the safe within the wall. Similar problems encountered in attempting to secure coventional safes to existing or new floor joist constructions. Also, the complex design of conventional safes make them costly to manufacture, thus precluding a large portion of the population from the benefits of this form of security. Lower cost models often do not provide adequate security in that they are fabricated from relatively light gauge metals and/or hinges may be disposed on the exterior of the safe thus rendering them susceptible to tampering.

It is, therefore, an object of the present invention to provide a safe which is simple in design and economical to manufacture.

It is another object of the present invention to provide a safe which provides a high degree of security against theft of its contents.

It is yet another object of the present invention to provide a safe which is easily installed in either new or existing construction.

It is still a further object of the present invention to provide a safe which may be easily adapted to a wide variety of applications.

Additional objects, advantages, and features of the present invention will become apparent from the following description of the preferred embodiment taken together with the drawings and appended claims.

BRIEF DESCRIPTION OF THE DRAWINGS

FIG. 1 is a perspective view of the safe shown in an installed relationship to an existing or new wall construction;

FIG. 2 is a sectional view of the safe of FIG. 1 taken along lines 2—2 and viewing from the back of the safe;

FIG. 3 is another embodiment of the invention shown in perspective;

FIG. 4 is another embodiment of the present invention shown embedded in a floor which is partially broken away;

FIG. 5 is yet another embodiment showing a grouping of several safes of the present invention in a free standing enclosure.

DETAILED DESCRIPTION OF THE PREFERRED EMBODIMENT

Referring now to FIGS. 1 and 2 of the drawings, a safe of the present invention is shown generally at 10. Safe 10 is rectangular in shape having side walls 12 and 14; a top, 16; bottom, 18; back, 20; and front, 22.

Front 22 is provided with an opening and a door 24 disposed within the opening. Door 24 may be of any desired size less than the size of front 22 but is preferably approximately half of the vertical height of safe 10 and slightly narrower than the horizontal width of safe 10. Door 24 is movalby hinged to front 22 by means of a first pair of cylindrical portions 26 and 28 secured to the interior surface of door 24 near the top thereof. These cylindrical portions preferably are welded to the door but may also be secured by any other suitable means so desired. A second pair of cylindrical portions 30 and 32 are secured to the interior surface of front 22 in like manner and in line with cylindrical portions 26 and 28. Cylindrical portions 26, 28, 30 and 32 all have a longitudinal bore extending their entire length. These cylindrical portions may be fabricated from any commonly available relatively small diameter pipe sectioned into short lengths.

A rod 34 is disposed within the bore of cylindrical portions 26 and 30 and has a diameter only slightly less than that of the bore. Rod 26 is of such a length as to extend fully through the bores of both cylindrical portions 26 and 30. Rod 34 is secured to cylindrical portion 26 by any means suitable to create a rigid immovable relationship therebetween such as by welding. In like manner, rod 36 is disposed within the bores of cylindrical portions 28 and 32 being rigidly secured to cylindrical portion 28. Thus, cylindrical portions 26, 28, 30 and 32 in cooperative relationship with rods 34 and 36 provide a strong durable hinge arrangement for door 24. Further, this hinge arrangement is not subject to tampering as it is disposed on the interior surface of door 24 and front 22. Also, by this arrangement, a smooth exterior front surface is preserved which may be easily concealed behind any suitable wall decoration.

Front 22 also has a door stop tab 38 secured to it on the interior surface thereof to prevent door 24 from swinging interiorly of the safe. Additionally, any desired type of security locking arrangement may also be fitted to the door such as a double key type system.

Interiorly of the safe 10 and extending along wall 12 between front 22 and back 20 is an angled member 40 which has a flange 42 protruding interiorly thereof. Angled member 40 is disposed on side wall 12 between the bottom edge of door 24 and bottom 18. In like manner and position, a second angled member 44 is secured to the interior surface of wall 14 and also has an interiorly extending flange portion 46. A shelf 48 extends between angled members 40 and 44 and is supported above the bottom of the safe by flange portions 42 and 46. Shelf 48 has a length and width only slightly smaller than the length and width of the safe interior thus allowing it to be easily pivoted upward to allow access to the lower portion 50 of the safe. When the safe is concealed behind a floor or wall, shelf 48 appears to be the bottom of the safe thus concealing the secret compartment 50 below.

Safe 10 has an overall exterior length and width so as to allow it to be easily installed in an existing wall between existing conventional wood studs which are normally placed 16 inches apart, center to center, and have nominal dimensions of 2 by 4 inches, and accurate dimensions of 1½ by 3½inches. Two spaced apart apertures 52 and 54 are provided in wall 12 through which lag bolts 56 and 58 are inserted to secure safe 10 to stud 60. Similarly, wall 14 is also provided with like apertures for insertion of lag bolts 62 and 64 to secure safe 10 to stud 66. It should be noted, however, that while lag bolts are the preferred means to secure the safe to the studs, any other suitable means may also be used, such as nails or the like. As the means to fasten the safe to the studs is disposed interiorly of the safe, any unauthorized removal of the entire safe is necessarily frustrated.

Another embodiment of the present invention is shown at 68 of FIG. 3. Safe 68 is similar in construction to that of safe 10 but is designed for floor installation. Safe 68 has side walls 72, 74, 76 and 78 and a bottom 80 secured to one end of these side walls. Bottom 80 extends outwardly beyond side walls 72, 74, 76 and 78 so as to form a flange 82 around the perimeter of safe 68. Flange 82 serves to securely anchor safe 68 in a concrete or like composition floor. An additional flange portion 84 is secured to sidewalls 72, 74, 76 and 78 at the top of safe 68 and extends above the top edge of the sidewalls and outwardly therefrom, thus forming a recess to retain a dust cover 88. When safe 68 is installed, flange 84 will be flush with floor 68. A secret compartment may also be provided in safe 68 in the same manner as described above for safe 10.

Another embodiment of the present invention is shown at 90 of FIG. 4. Safe 90 is substantially of the same construction as that shown in FIG. 3 but lacking the top and bottom flange portions 82 and 84. Safe 90 is designed to be mounted on any desired surface in either a vertical or horizontal arrangement. Apertures may be provided in either the side, bottom, or both to accommodate bolts or the like for securing safe 90 to the desired surface. Additionally, safe 90 may be secured to a metal structure such as a vehicle frame by welding.

Door 70 of safe 90 has a vertical height which is less than the vertical dimension of the opening 92 such that when door 70 is in a closed position, an open portion 94 extending into the interior of the safe remains. There is thus provided means by which deposits may be placed within the safe by an individual not possessed of means to unlock the safe. This feature is particularly desirable for installations at gasoline service stations or other business establishments which may be prone to robbery attempts. It should be noted that, while this feature is described with reference to the embodiment of FIG. 3, it may be incorporated into any of the other embodiments disclosed herein. Additionally, several of safes 90 may be grouped together into a common structure 96 as shown in FIG. 5. The individual safes may be joined in any desired manner such as welding or bolting to a grid work, which is then covered with a decorative outer layer such as a wood or plastic laminate veneer. The common structure 96 may be secured to the floor if so desired by bolting thereto from the inside bottom of the lower tier of safes. In such a form, the safes are ideally suited for placement in motel or hotel lobbies thus affording a safe secure receptacle for guest's valuables.

The embodiments of the safe shown in FIGS. 3, 4 and 5 are preferably manufactured from standard size rectangular or square steel tubing having a wall thickness of the order of 0.25 inch. This tubing may be cut to the desired length thereafter which, a back or bottom is securely welded thereto and a door fitted to the other end. Thus, the use of such standard tubing allows the safe to be economically constructed while also providing a virtually indestructible enclosure affording a high degree of security.

I claim:

1. A safe for installation between a pair of wall studs, said safe comprising:

a metal enclosure having a top, bottom, front, back, and opposing side walls of a single thickness; said enclosure having a width equal to the lateral spacing between the studs and a thickness equal to approximately the thickness of the studs;

said front having an opening therein;

a metal door disposed within said opening and extending laterally substantially the entire distance between the studs; hinge means movably securing said door to said metal enclosure, said hinge means being disposed interiorly of said enclosure so as to preclude unauthorized tampering therewith, said hinge means comprising;

a pair of first cylindrical members secured to an interior surface of said door adjacent opposite sides thereof and also adjacent a third side of said door, said cylindrical members having a longitudinal bore extending therethrough;

a pair of second cylindrical members each secured to an interior surface of said enclosure adjacent said opening and one of said first cylindrical members; said second cylindrical members having a longitudinal bore extending therethrough; and a pair of rod members, one end of each being fixedly secured inside of said bore of selected one of said first pair of cylindrical members, the other end of said rod passing through said bore of selected one of said second pair of cylindrical members and being easily rotatable therein;

locking means on said door to secure said door in a closed position and prevent unauthorized opening thereof;

a pair of angled members secured to the interior surface of said opposing side walls and extending between said front and back walls, said angled members being disposed below said opening;

a false bottom removably engaging said angled members so as to conceal a portion of said enclosure below said false bottom;

each of said side walls further having two laterally disposed apertures therein, one pair of said apertures being disposed above said false bottom and the other pair of apertures being disposed below said false bottom; and two pairs of laterally outwardly projecting fastening elements disposed one in each of said apertures and engaged with the confronting portion of the adjacent studs for fixedly securing the safe within the wall.

* * * * *